US005142785A

United States Patent [19]

Grewal et al.

[11] Patent Number: 5,142,785

[45] Date of Patent: Sep. 1, 1992

[54] RAZOR TECHNOLOGY

[75] Inventors: Manohar S. Grewal, Hanover; Chong-Ping P. Chou, Lexington, both of Mass.

[73] Assignee: The Gillette Company, Boston, Mass.

[21] Appl. No.: 759,812

[22] Filed: Aug. 26, 1991

Related U.S. Application Data

[63] Continuation of Ser. No. 692,010, Apr. 26, 1991, abandoned.

[51] Int. Cl.[5] ..... B26B 21/54

[52] U.S. Cl. ..... 30/32; 30/346.54; 76/104.1; 76/DIG. 8

[58] Field of Search ..... 30/346.54, 346.5, 350; 76/104.1, 101.1, DIG. 8; 204/192.15, 192.16, 192.3

[56] References Cited

U.S. PATENT DOCUMENTS

| | | | |
|---|---|---|---|
| 3,652,443 | 3/1972 | Fish . | |
| 3,761,372 | 9/1973 | Sastri . | |
| 3,761,373 | 9/1973 | Sastri | 76/104.1 X |
| 3,829,969 | 8/1974 | Fischbein . | |
| 3,900,636 | 8/1975 | Curry . | |
| 3,911,579 | 10/1975 | Lane et al. | 76/104.1 X |
| 3,961,103 | 6/1976 | Aisenberg . | |
| 4,416,912 | 11/1983 | Bache . | |
| 4,434,188 | 2/1984 | Kamo . | |
| 4,490,229 | 12/1984 | Mirtich . | |
| 4,504,519 | 3/1985 | Želez . | |
| 4,816,286 | 3/1989 | Hirose . | |
| 4,816,291 | 3/1989 | Desphandey . | |
| 4,822,466 | 4/1989 | Rabalais | 204/192.15 |
| 4,849,290 | 7/1989 | Fujimori . | |
| 4,902,535 | 2/1990 | Garg . | |
| 4,933,058 | 6/1990 | Bache | 204/192.3 |

FOREIGN PATENT DOCUMENTS

| | | | |
|---|---|---|---|
| 3047888 | 7/1982 | Fed. Rep. of Germany | 30/346.54 |
| WO90/03455 | 4/1990 | World Int. Prop. O. . | |

OTHER PUBLICATIONS

Knight et al., "Characterization of Diamond Films by Raman Spectroscopy", J. Mater. Res., vol. 4, No. 2, Mar./Apr. 1989.

*Primary Examiner*—Douglas D. Watts
*Attorney, Agent, or Firm*—Fish & Richardson

[57] ABSTRACT

A razor blade includes a substrate with a wedge-shaped edge, a layer of molybdenum on the tip and flanks of the wedge-shaped edge, the thickness of the molybdenum layer preferably being in the range of about 50–500 angstroms, and a layer of diamond or diamond-like material on the molybdenum layer that preferably has a thickness of about 200–1,500 angstroms and that defines a tip radius of less than about 1000 angstroms.

19 Claims, 1 Drawing Sheet

RAZOR TECHNOLOGY

This is a continuation of application Ser. No. 07/692,010, filed Apr. 26, 1991, now abandoned.

This invention relates to improved razors and razor blades and to processes for producing razor blades or similar cutting tools with sharp and durable cutting edges.

A razor blade typically is formed of suitable substrate material such as metal or ceramic and an edge is formed with wedge-shaped configuration with an ultimate edge or tip that has a radius of less than about 1,000 angstroms, the wedge shaped surfaces having an included angle of less than 30°. As shaving action is severe and blade edge damage frequently results and to enhance shavability, the use of one or more layers of supplemental coating material has been proposed for shave facilitation, and/or to increase the hardness and/or corrosion resistance of the shaving edge. A number of such coating materials have been proposed, such as polymeric materials and metals, as well as other materials including diamond and diamond-like carbon (DLC) material. Each such layer or layers of supplemental material must have adhesion compatibility so that each layer remains firmly adhered to the substrate throughout the useful life of the razor blade, and desirably provide characteristics such as improved shavability, improved hardness and/or corrosion resistance while not adversely affecting the geometry and cutting effectiveness of the shaving edge. It has been proposed to provide the cutting edges of razor blades with improved mechanical properties by applying to the sharpened edge of the substrate a coating of diamond or diamond-like carbon (DLC) material. Such materials may be characterized as having substantial sp3 carbon bonding; a mass density greater than 1.5 grams/cm$^3$; and a Raman peak at about 1331 cm$^{-1}$ (diamond) or about 1552 cm$^{-1}$ (DLC). However, such proposals have not been satisfactory due to the tendency of the diamond or diamond-like coating to have poor adhesion to and to peel off from the wedge-shaped edge of the substrate.

In accordance with one aspect of the invention, there is provided a razor blade comprising a substrate with a wedge-shaped edge, a layer of molybdenum on the tip and flanks of the wedge-shaped edge, the thickness of the molybdenum layer preferably being in the range of about 50–500 angstroms, and a layer of diamond or diamond-like material on the molybdenum layer that preferably has a thickness of about 200–1,500 angstroms and that defines a tip radius of less than about 1000 angstroms. The blade exhibits excellent shaving properties and long shaving life.

In particular embodiments, the razor blade substrate is steel; the wedge-shaped edge is formed by a sequence of mechanical abrading steps; and the layers of molybdenum and diamond-like carbon material are formed by sputtering material from high purity targets of molybdenum and graphite.

In accordance with another aspect of the invention, there is provided a process for forming a razor blade that includes the steps of providing a substrate, forming on an edge of the substrate a wedge-shaped sharpened edge that has an included angle of less than 30° and a tip radius (i.e. the estimated radius of the larger circle that may be positioned within the ultimate tip of the edge when such ultimate tip is viewed under a scanning electron microscope at magnifications of at least 25,000) preferably of less than 1,200 angstroms; depositing a layer of molybdenum on the sharpened edge; and depositing a layer of diamond or diamond-like material on the molybdenum layer to provide a radius at the ultimate tip of the diamond or diamond-like material of less than about 1,000 angstroms.

The diamond and DLC layers may be deposited by various techniques such as plasma decomposition of hydrocarbon gases, sputter deposition using ions from either a plasma or an ion gun to bombard a graphite target, directly using a beam of carbon ions, and ion beam assisted deposition (IBAD) process using either E-Beam or sputtering sources.

In a particular process, the substrate is mechanically abraded in a sequence of grinding, rough-honing and finish-honing steps to form the sharpened edge; the layers of molybdenum and diamond or diamond-like material are deposited by sputtering; the molybdenum layer having a thickness of less than about five hundred angstroms, and the diamond or DLC coating on the molybdenum coated cutting edge having a thickness of less than about fifteen hundred angstroms; the layer of diamond or diamond-like carbon (DLC) material having a Raman peak at about 1331 cm$^{-1}$ (diamond) or about 1552 cm$^{-1}$. (DLC); substantial sp3 carbon bonding; and a mass density greater than 1.5 grams/cm$^3$; and an adherent polymer coating is applied on the diamond or DLC coated cutting edge. In accordance with another aspect of the invention, there is provided a shaving unit that comprises blade support structure that has external surfaces for engaging user skin ahead and rearwardly of the blade edge or edges and at least one blade member secured to the support structure. The razor blade structure secured to the support structure includes a substrate with a wedge-shaped cutting edge, a layer of molybdenum on the tip and flanks of the wedge-shaped edge, and a layer of diamond or diamond-like carbon material on top of the molybdenum layer.

In a particular shaving unit, the razor blade structure includes two substrates, the coated wedge-shaped edges are disposed parallel to one another between the skin-engaging surfaces; each molybdenum layer has a thickness of less than about five hundred angstroms; each diamond or DLC coating has a thickness of less than about fifteen hundred angstroms; each layer of diamond or diamond-like carbon material has substantial sp3 carbon bonding; a mass density greater than 1.5 grams/cm$^3$; and a Raman peak at about 1331 cm$^{-1}$ (diamond) or about 1552 cm$^{-1}$ (DLC); and an adherent polymer coating is on each layer of diamond or diamond-like carbon material.

The shaving unit may be of the disposable cartridge type adapted for coupling to and uncoupling from a razor handle or may be integral with a handle so that the complete razor is discarded as a unit when the blade or blades become dull. The front and rear skin engaging surfaces cooperate with the blade edge (or edges) to define the shaving geometry. Particularly preferred shaving units are of the types shown in U.S. Pat. No. 3,876,563 and in U.S. Pat. No. 4,586,255.

Other features and advantages of the invention will be seen as the following description of particular embodiments progresses, in conjunction with the drawings, in which.

DESCRIPTION OF PARTICULAR EMBODIMENTS

Figure 1:
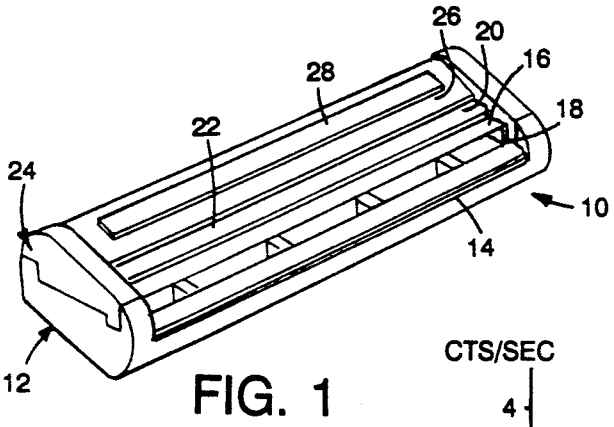
FIG. 1 is a perspective view of a shaving unit in accordance with the invention.

With reference to FIG. 1, shaving unit 10 includes structure for attachment to a razor handle, and a platform member 12 molded of high-impact polystyrene that includes structure defining forward, transversely-extending skin engaging surface 14. Mounted on platform member 12 are leading blade 16 having sharpened edge 18 and following blade 20 having sharpened edge 22. Cap member 24 of molded high-impact polystyrene has structure defining skin-engaging surface 26 that is disposed rearwardly of blade edge 22, and affixed to cap member 24 is shaving aid composite 28.

Figure 2:
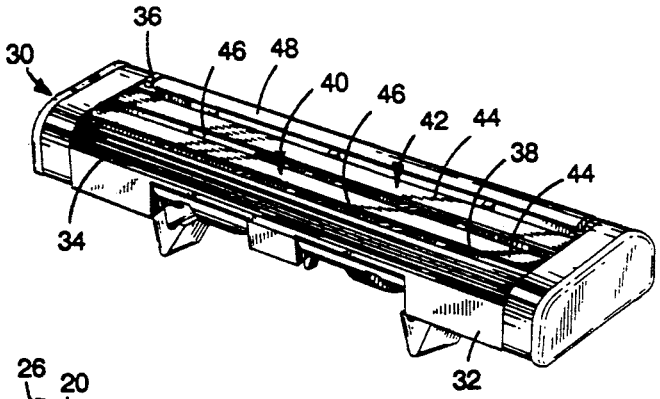
FIG. 2 is a perspective view of another shaving unit in accordance with the invention.

The shaving unit 30 shown in FIG. 2 is of the type shown in Jacobson U.S. Pat. No. 4,586,255 and includes molded body 32 with front portion 34 and rear portion 36. Resiliently secured in body 32 are guard member 38, leading blade unit 40 and trailing blade unit 42. Each blade unit 40, 42 includes a blade member 44 that has a sharpened edge 46. A shaving aid composite 48 is frictionally secured in a recess in rear portion 36.

Figure 3:
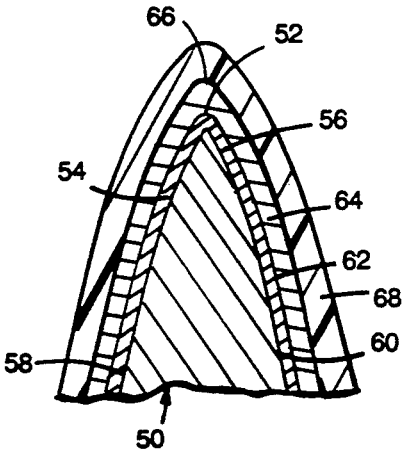
FIG. 3 is a diagrammatic view illustrating one example of razor blade edge geometry in accordance with the invention.

A diagrammatic view of the edge region of the blades 16, 20 and 44 is shown in FIG. 3. The blade includes stainless steel body portion 50 with a wedge-shaped sharpened edge formed in a sequence of edge forming operations that include a grinding operation, a rough honing operation, and a finish honing operation that forms a tip portion 52 that has a radius typically less than 1,000 angstroms with finish hone facets 54 and 56 that diverge at an angle of about 14° and merge with rough hone facets 58, 60. Deposited on tip 52 and facets 54–60 is interlayer 62 of molybdenum that has a thickness of less than about 500 angstroms. Deposited on molybdenum interlayer 62 is outer layer 64 of diamond-like carbon (DLC) that has a thickness of up to about 1,500 angstroms, and an aspect ratio (the ratio of the distance from DLC tip 66 to stainless steel tip 52 and the width of the DLC coating 64 at tip 52) of less than about 3:1. Deposited on layer 64 is an adherent telomer layer 68.

Figure 4:
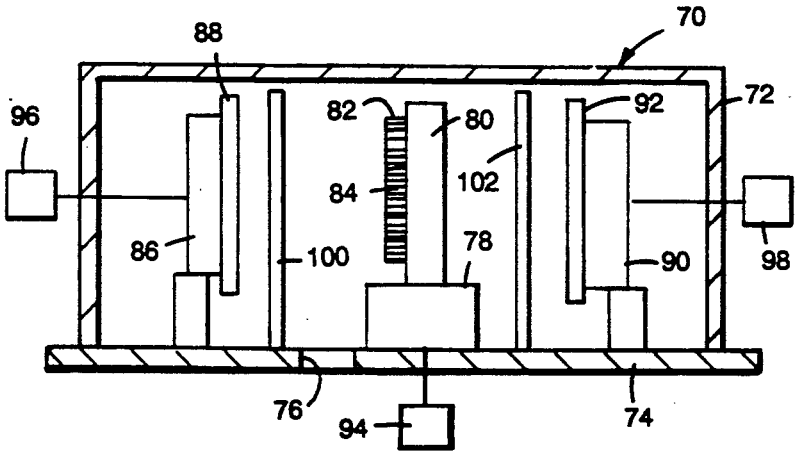
FIG. 4 is a diagrammatic view of apparatus for the practice of the invention.

Apparatus for processing blades of the type shown in FIG. 3 is diagrammatically illustrated in FIG. 4. That apparatus includes a DC planar magnetron sputtering system manufactured by Vac Tec Systems of Boulder, Colo. that has stainless steel chamber 70 with wall structure 72 and base structure 74 in which is formed port 76 coupled to a suitable vacuum system (not shown) Mounted in chamber 70 is carousel support 78 with upstanding support member 80 on which is disposed a stack of razor blades 82 with their sharpened edges 84 in alignment and facing outwardly from support 80. Also disposed in chamber 70 are support structure 86 for target member 88 of molybdenum (99.99% pure) and support structure 90 for target member 92 of graphite (99.999% pure). Targets 88 and 92 are vertically disposed plates, each about twelve centimeters wide and about thirty-seven centimeters long. Support structures 78, 86 and 90 are electrically isolated from chamber 70 and electrical connections are provided to connect blade stack 82 and targets 88 and 92 to appropriate energizing apparatus 94, 96, 98, respectively. Shutter structures 100 and 102 are disposed adjacent target 88, 92, respectively, for movement between a position obscuring its adjacent target and an open position.

Carousel 78 supports the blade stack 82 with the blade edges 84 spaced about seven centimeters from the opposed target plate 88, 92, and is rotatable about a vertical axis between a first position in which blade stack 82 is in opposed alignment with molybdenum target 88 (FIG. 4) and a second position in which blade stack 82 is in opposed alignment with graphite target 92.

Figure 5:
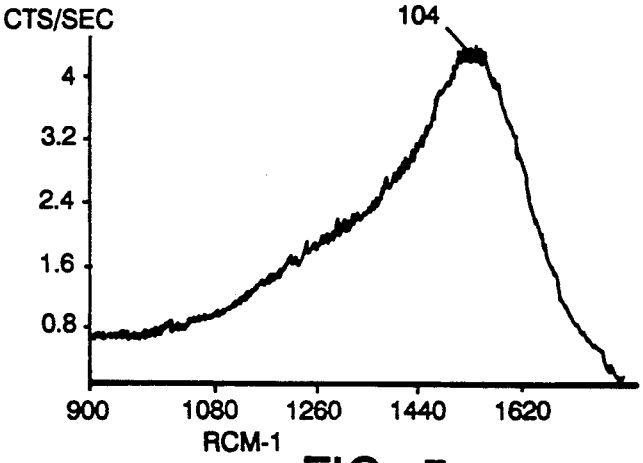
FIG. 5 is a Raman spectrograph of DLC material deposited with the apparatus of FIG. 4.

In a particular processing sequence, chamber 70 is evacuated; the targets 88, 92 are cleaned by DC sputtering for five minutes; the blades 82 are then RF cleaned in an argon environment at a pressure of ten millitorr at a power of 1.5 kilowatts and an argon flow of 200 sccm; the argon flow reduced to 150 sccm at a pressure of two millitorr in chamber 70; shutter 100 in front of molybdenum target 88 is opened, and target 88 is sputtered at one kilowatt power with a bias of −150 volts on blades 82 for twenty-two seconds to deposit a molybdenum layer 52 of about 200 angstroms thickness on the blade edges 84. Shutter 100 is then closed. Then carousel 78 is then rotated 180° to juxtapose blade stack 82 with graphite target 92. Pressure in chamber 70 is maintained at two millitorr with an argon flow of 150 sccm, shutter 102 is opened, and graphite target 92 is sputtered at 900 watts with a bias of −150 volts on blades 82 for 10 minutes to deposit a DLC layer 54 of about 800 angstroms thickness on molybdenum layer 52. As illustrated in FIG. 5, Raman spectroscopy of the coating material 54 deposited in this process shows a broad Raman peak 104 centered at about 1525 $cm^{-1}$ wave number, a spectrum typical of DLC structure. The DLC coating 54 was firmly adherent to the blade body 40 and withstood repeated applications of wool felt cutter forces, indicating that the DLC coating 54 is substantially unaffected by exposure to the severe conditions of this felt cutter test and remains firmly adhered to the blade body 40. Its tip 66 had a radius of about 700 angstroms and an aspect ratio of 1.7:1.

A coating 68 of polytetrafluoroethylene telomer is then applied to the DLC-coated edges of the blades in accordance with the teaching of U.S. Pat. No. 3,518,110. This process involves heating the blades in a neutral atmosphere such as nitrogen or argon or a reducing atmosphere such as cracked ammonia and providing on the cutting edges of the blades an adherent and friction-reducing polymer coating of solid PTFE.

The resulting blade elements 44 were assembled in cartridge units 30 of the type shown in FIG. 2 and shaved with excellent shaving results.

In another processing sequence, chamber 70 was evacuated; the targets 88, 92 were cleaned by DC sputtering for five minutes; the blades 82 were then RF cleaned in an argon environment at a pressure of ten millitorr at a power of 1.5 kilowatts and an argon flow of 200 sccm for two minutes; the argon flow reduced to 150 sccm at a pressure of two millitorr in chamber 70; shutter 100 in front of molybdenum target 88 was then opened; and target 88 was sputtered at one kilowatt power with a bias of −150 volts on blades 82 for thirty-two seconds to deposit a molybdenum layer 52 of about 300 angstroms thickness on the blade edges 84. Shutter 100 was closed and carousel 78 was rotated 180° to juxtapose blade stack 82 with graphite target 92. Pressure in chamber 70 was maintained at two millitorr with an argon flow of 150 sccm, shutter 102 was opened, and graphite target 92 was sputtered at 500 watts with a bias of −100 volts on blades 82 for ten minutes to deposit a DLC layer 54 of about 1,000 angstroms thickness on molybdenum layer 52. The resulting blades had firmly adherent DLC coatings 54 and were shaved with excellent shaving results.

In another processing sequence, chamber 70 was evacuated; targets 88, 92 were cleaned by DC sputtering for five minutes; blades 82 were then RF cleaned in an argon environment at a pressure of ten millitorr at a power of 1.5 kilowatts and an argon flow of 200 sccm for two minutes; the argon flow reduced to 150 sccm at a pressure of two millitorr in chamber 70; shutter 100 in front of molybdenum target 88 was then opened; and target 88 was sputtered to deposit a molybdenum layer 52 of about 200 angstroms thickness on the blade edges 84. Shutter 100 was closed and carousel 78 was rotated 180° to juxtapose blade stack 82 with graphite target 92. Pressure in chamber 70 was maintained at two millitorr with an argon flow of 150 sccm, shutter 102 was opened, and graphite target 92 was sputtered at 600 watts to deposit a DLC layer 54 of about 300 angstroms thickness on molybdenum layer 52. The DLC coating was firmly adherent on resulting blades, and the DLC tips 66 had a radius of about 500 angstroms.

While particular embodiments of the invention has been shown and described, various modifications will be apparent to those skilled in the art, and therefore, it is not intended that the invention be limited to the disclosed embodiments, or to details thereof, and departures may be made therefrom within the spirit and scope of the invention.

What is claimed is:

1. A process for forming a razor blade comprising the steps of providing a substrate, forming a wedge-shaped sharpened edge on said substrate that has an included angle of less than thirty degrees and a tip radius of less than twelve hundred angstroms;

depositing a layer of molybdenum on said sharpened edge;

depositing a layer of diamond or diamond-like carbon material on said molybdenum layer; and applying an adherent polymer coating on said diamond or DLC coated cutting edge.

2. The process of claim 1 wherein said substrate is mechanically abraded in a sequence of grinding, rough-honing and finish-honing steps to form said sharpened edge.

3. The process of claim 2 wherein said finish-honing step forms facets that have an included angle of less than thirty degrees.

4. The process of claim 1 wherein said molybdenum layer on said cutting edge has a thickness of less than about five hundred angstroms, and said diamond or DLC coating on said molybdenum coated cutting edge has a thickness of less than about fifteen hundred angstroms.

5. The process of claim 1 wherein said step of forming said wedge-shaped edge includes a finish-honing step that forms a sharpened edge with an ultimate tip radius of less than about twelve hundred angstroms.

6. The process of claim 1 wherein said layer of diamond or DLC carbon material is deposited by a technique selected from the group consisting of plasma decomposition of hydrocarbon gases, sputter deposition using ions from either a plasma or an ion gun to bombard a graphite target, directly using a beam of carbon ions, and an ion beam assisted deposition (IBAD) process using either E-Beam or sputtering sources.

7. A process for forming a razor blade comprising the steps of providing a substrate, forming on said substrate a wedge-shaped edge that has an included angle of less than 30° and a tip radius less than 1,200 angstroms; depositing a layer of molybdenum on said wedge-shaped edge; depositing a layer of diamond or diamond-like material on said molybdenum layer to provide a radius at the ultimate tip of said diamond or diamond-like material of less than 1,200 angstroms; and applying and adherent polymer coating on said diamond or DLC coated cutting edge.

8. The process of claim 7 wherein said layers of molybdenum and diamond or diamond-like material are deposited by sputtering.

9. The process of claim 7 wherein said molybdenum layer on said wedge-shaped edge has a thickness of less than about five hundred angstroms, and said diamond or DLC coating on said molybdenum coated cutting edge has a thickness of less than about fifteen hundred angstroms.

10. A razor blade comprising a substrate with a wedge-shaped edge defined by facets that have a width of at least about 0.1 millimeter and an included angle of less than thirty degrees, a layer of molybdenum on said wedge-shaped edge; a layer of diamond or diamond-like carbon material on said molybdenum layer; and applying an adherent polymer coating on said diamond or DLC coated cutting edge.

11. The razor blade of claim 10 wherein said layer of diamond or diamond-like carbon (DLC) material has a Raman peak at about 1331 $cm^{-1}$ (diamond) or about 1552 $cm^{-1}$ (DLC).

12. The razor blade of claim 11 wherein said layer of diamond or diamond-like carbon (DLC) has an aspect ratio of less than about 3:1; substantial sp3 carbon bonding; and a mass density greater than 1.5 grams/$cm^3$.

13. The razor blade of claim 11 wherein said molybdenum layer has a thickness of less than about five hundred angstroms, and said diamond or DLC coating on said molybdenum layer has a thickness of less than about fifteen hundred angstroms.

14. A razor blade comprising a substrate with a wedge-shaped edge, a layer of molybdenum on the tip and flanks of said wedge-shaped edge, the thickness of said molybdenum layer being in the range of about 50–500 angstroms, and a layer of diamond or diamond-like carbon material on said molybdenum layer, said layer of diamond or diamond-like carbon material having a thickness of about 200–1,500 angstroms and defining a tip radius of less than about 1,000 angstroms.

15. The razor blade of claim 14 wherein said substrate is steel; said wedge-shaped edge is formed by a sequence of mechanical abrading steps; and said layers of molybdenum and diamond or diamond-like carbon material are formed by sputtering.

16. The razor blade of claim 15 wherein said layer of diamond or diamond-like carbon (DLC) material has substantial sp3 carbon bonding; a mass density greater than 1.5 grams/$cm^3$; and a Raman peak at about 1331 $cm^{-1}$ (diamond) or about 1552 $cm^{-1}$ (DLC); and further including an adherent polymer coating on said layer of diamond or diamond-like carbon material.

17. A shaving unit comprising support structure that defines spaced skin-engaging surfaces, and razor blade structure secured to said support structure, said razor blade structure including a substrate with a wedge-shaped edge, a layer of molybdenum on said wedge-shaped edge; a layer of diamond or diamond-like carbon material on said molybdenum layer, said diamond or diamond-like carbon coated wedge-shaped edge being disposed between said skin-engaging surfaces; and an adherent polymer coating on each said layer of diamond or diamond-like carbon material.

18. The shaving unit of claim 17 wherein said razor blade structure includes two substrates, and said coated wedge-shaped edges are disposed parallel to one another between said skin-engaging surfaces.

19. The shaving unit of claim 18 wherein each said layer of diamond or diamond-like carbon material has substantial sp3 carbon bonding; a mass density greater than 1.5 grams/$cm^3$; and a Raman peak at about 1331 $cm^{-1}$ (diamond) or 1552 $cm^{-1}$ (DLC); each said molybdenum layer has a thickness of less than five hundred angstroms; and each said diamond or DLC coating on said molybdenum layer has a thickness of less than fifteen hundred angstroms.

* * * * *